US005507877A

United States Patent [19]

Magsig et al.

[11] Patent Number: 5,507,877

[45] Date of Patent: Apr. 16, 1996

[54] DISHWASHING MACHINE

[75] Inventors: Juergen Magsig, Meckenbeuren; Reiner Muensterer, Tettnang, both of Germany

[73] Assignee: Winterhalter Gastronom GmbH, Meckenbeuren, Germany

[21] Appl. No.: 256,507

[22] PCT Filed: Nov. 16, 1993

[86] PCT No.: PCT/DE93/01089

§ 371 Date: Jul. 14, 1994

§ 102(e) Date: Jul. 14, 1994

[87] PCT Pub. No.: WO94/10895

PCT Pub. Date: May 26, 1994

[30] Foreign Application Priority Data

Nov. 16, 1992 [DE] Germany ..... 42 38 617.9

[51] Int. Cl.[6] ..... A47L 15/24

[52] U.S. Cl. ..... 134/18; 134/25.2; 134/26; 134/32; 134/46; 134/48; 134/49; 134/50; 134/60; 134/72

[58] Field of Search ..... 134/46, 48, 49, 134/50, 60, 68, 72, 25.2, 18, 26, 32

[56] References Cited

U.S. PATENT DOCUMENTS

| | | | |
|---|---|---|---|
| 1,512,918 | 10/1924 | Forsgard | 134/48 X |
| 1,660,345 | 2/1928 | Merseles | 134/49 |
| 1,664,637 | 4/1928 | Merseles et al. | 134/72 X |
| 1,993,154 | 3/1935 | Elkington | 134/49 X |
| 2,073,521 | 3/1937 | Johnston et al. | 134/49 |
| 2,550,523 | 4/1951 | Borgerding | 134/49 |
| 2,746,466 | 5/1956 | Clague et al. | 134/72 |
| 3,009,466 | 11/1961 | Fox et al. | 134/72 X |
| 3,254,698 | 6/1966 | Fox et al. . | |
| 4,280,520 | 7/1981 | Fraula et al. | 134/60 |
| 4,357,176 | 11/1982 | Anthony | 134/49 X |

FOREIGN PATENT DOCUMENTS

| | | | |
|---|---|---|---|
| 0036217 | 9/1981 | European Pat. Off. . | |
| 1391170 | 1/1965 | France . | |
| 1928642 | 12/1965 | Germany . | |
| 1953712 | 1/1967 | Germany . | |
| 1963534 | 7/1967 | Germany . | |
| 1968268 | 9/1967 | Germany . | |
| 1983654 | 4/1968 | Germany . | |
| 1728256 | 4/1972 | Germany . | |
| 2515993 | 10/1976 | Germany . | |
| 3010331 | 10/1981 | Germany . | |
| 286134 | 3/1928 | United Kingdom | 134/72 |
| 386006 | 1/1933 | United Kingdom | 134/49 |
| 2087717 | 6/1982 | United Kingdom . | |

*Primary Examiner*—Philip R. Coe
*Attorney, Agent, or Firm*—Spencer & Frank

[57] ABSTRACT

A dishwashing machine is proposed which is considerably shorter in design than the previously used, continuously operated transport-dishwashers. In order permanently to reduce the consumption of water, energy and rinsing agent, the crockery in the individual crockery baskets is washed cyclical operation, the circuits of the rinsing apparatus being started up only in their respective time span within the wash program.

20 Claims, 5 Drawing Sheets

DISHWASHING MACHINE

BACKGROUND OF THE INVENTION

The invention relates to a dishwashing machine for cleaning crockery. The dishwashing machine has a rinsing chamber which includes a washing and rinsing zone, and in which there are provided a large number of washing and re-rinsing nozzles. A transporting device longitudinally traverses the rinsing chamber and transports the crockery. The rinsing chamber has an entry opening which is followed by a first washing zone.

PRIOR ART

Industrial machines of this type generally serve for the cleaning of plates, cups, cutlery and other crockery items which crop up, in particular, in catering and similar businesses.

Known industrial machines exhibit a permanently running transport system for the crockery baskets or crockery boxes which receive the crockery to be cleaned. This involves push rods which run to and fro and have pawls which engage in corresponding transverse bars on the underside of the baskets as the push rods move an the direction of transport. The wash batch herein runs through various washing and re-rinsing zones as treatment stations, which can be separated from one another by synthetic curtains. The washing or rinsing circuits within the dishwasher are herein also constantly in operation. The length of a wash or rinse cycle herein depends upon the transport speed of the crockery and the length of the treatment stations. This working method, even if, as usual, only two treatment zones are present, gives rise to a considerable spatial requirement for the dishwasher. Firstly, each treatment zone has to correspond to the path distance covered by a crockery basket during the wash or rinse cycle and is therefore generally significantly larger than one basket length. Secondly, the dividing curtains are raised by a basket as it passes, until such time as the basket has been guided, to the whole of its length, through below the dividing curtain. This does not produce good demarcation of the various treatment zones within the dishwasher. Consequently, hot vapors or spray mists pass increasingly from one treatment zone to the other or escape from the machine, this being associated with a corresponding energy and water loss and generally with poorer rinsing results. In the interior of the dishwasher, this can consequently result in suds being carried over from the so-called "washing zone" into the so-called "re-rinsing zone". This leads to an increased loss of washing suds, which loss has to be counterbalanced, in turn, by a corresponding material and energy expenditure. In order better to demarcate the washing zone from the re-rinsing zone, drain-off regions, which are once again separated by curtains, were provided between the rinsing stations. This leads once again, however, to an increase in the spatial requirement of the machine.

It is of considerable disadvantage, moreover, that the rinsing agent circuit for the individual rinsing stations, just like the transporting device, is constantly operated. This is even the case where there are no longer any baskets on the transporting device. The dishwasher runs, in this case, without any effective benefit, whereby the energy which is herein consumed is uselessly wasted, producing a corresponding increase in running costs. Although this disadvantage has in some cases been partially counterbalanced by so-called "automatic timers", the entire washing and rinsing mechanism which comes into question has nevertheless been set in motion.

From DE-U-1 928 642 there has also become known an industrial dishwashing machine having automatic crockery transport, in which the crockery is automatically introduced into the interior of the dishwasher and the transportation subsequently interrupted. Whilst the crockery resting in crockery baskets remains stationary within the work housing, washing firstly and then re-rinsing are carried out via a program switching mechanism. During the washing and re-rinsing procedure, the position of the crockery consequently remains unaltered and is only subsequently led out of the machine.

Although such a working method for the dishwashing machine has the advantage that the spatial requirement of the machine can be substantially reduced compared to the previously described dishwasher design, the dwell time of the crockery within the machine is increased due to the stationary position of the crockery basket up to the end of all treatment cycles. Object and advantages of the invention:

The object of the invention is to propose a dishwashing machine which exhibits a minimal spatial requirement combined with optimal washing performance.

This object is achieved by providing a rinsing chamber having an entry opening. The rinsing chamber includes a washing zone located subsequent to the entry opening. Further, the rinsing chamber includes a plurality of washing nozzles for washing the crockery within the washing zone during a washing cycle. A rinsing zone is located immediately adjacent to and immediately following the washing zone. Further, a plurality of rinsing nozzles for rinsing the crockery within the rinsing zone during a rinsing cycle are provided. The rinsing cycle occurs after a completion of the washing cycle and during the transportation of the crockery. A transporting device longitudinally traverses the rinsing chamber for transporting the crockery through the entry opening, the washing zone, and the rinsing zone, respectively. The transporting device causes the crockery to dwell within the washing zone during the washing cycle for a predetermined time. Additionally, control means are provided for controlling a temporal sequencing of the rinse cycle and a transport cycle.

The invention is based upon the core concept that an optimum of performance, a minimum of consumption of energy, water and chemical additives, and a minimum of spatial requirement can only be obtained by an optimized dishwashing machine design. Consequently, in the dishwashing machine according to the invention, the batch to be washed runs through the machine not as usual at slow speed, but is drawn quickly into the machine and stays for a long time in the spheres of action or treatment zones, so as thereafter to leave the machine quickly. This produces long contact times in the treatment cycle and short run-through times in the motional cycle. As a result of the space-saving design, by virtue of the working principle, according to the invention, of the dishwashing machine, the latter can be used in virtually any dish-washing room in the catering and hotel industries. The running of the dishwashing machine, due to the intermittent transport cycle, is extremely economical and environmentally friendly. In particular, the water consumption and the consumption of clear rinsing agent is halved, for example, whilst one-third less washing agent is required for the wash cycle. This produces a high saving in energy and working materials, which, not least, also results in low electrical connected loads for the machine.

The invention derives from the recognition that a stationary arrangement produces, in the wash cycle, an optimization of the working materials combined with a minimal space requirement. This working method involving the stationary treatment of crockery in the cleaning cycle, which working method is initially known per se, is optimized according to the present invention by the fact that the washing zone is immediately followed by the re-rinsing zone, so that the evacuation or travel-out time of the crockery can be used directly for the re-rinse cycle. This also enables the re-rinsing zone to be kept very short, which is beneficial to the spatial requirement of the machine.

The direct spatial proximity of the re-rinsing zone following the washing zone enables, on the one hand, the crockery to be optimally treated during the wash cycle, the crockery basket, during this phase, either remaining stationary or at least performing an only slightly oscillating to and fro motion. The subsequent re-rinse cycle is then executed as the crockery basket is transported away, the re-rinsing agent, with its high fresh water component, simultaneously serving to regenerate the washing suds for the main rinse cycle.

The dishwashing machine according to the invention is consequently equipped with a program control, by means of which the positioning of the wash batch in the cleaning region of the dishwasher, the performance of a wash program whilst the crockery basket remains broadly still and the switching-off of the wash cycle following completion of the main wash cycle can be realized. The energy loss to the environment is herein significantly reduced by the fact that the liquid circuit for the main wash cycle—hereinafter referred to as the "wash cycle"—is switched off as soon as the transport motion is conducted. Only once the wash batch is positioned in its washing position is the actual wash cycle started. A flexible dividing curtain is already again concealing the entire feed opening, as a result of which the interior of the dishwashing machine, which interior is configured as a rinsing chamber or treatment chamber, is effectively screened off. The washing zone of the rinsing chamber itself can be matched roughly to the size of a conventional crockery basket base layout, or can even be dimensioned larger, since the wash batch remains still during the wash cycle. Since transportation resumes only once the wash cycle is completed, there is no longer any need for an actual drain-off region between the washing zone and the re-rinsing zone. It is nevertheless advisable for a short drain-off time to be realized between the treatment cycles in order to reduce the carry-over of washing suds into the re-rinsing zone. The spatial requirement of the dishwasher according to the invention is thereby optimized to a minimum.

The measure ensuring that the liquid circuit both for the wash cycle and for the re-rinse cycle is only ever started up during the respective treatment cycle brings a significant reduction in the consumption of energy, water and cleaning agent.

Since the re-rinse cycle is altogether less time-intensive than the wash cycle, it is particularly advantageous for the re-rinse cycle to be performed after the wash cycle such that the crockery, during the re-rinse cycle, runs through the re-rinsing zone and hence the travel-out time is utilized for the re-rinse cycle.

The dishwashing machine according to the invention operates in the main wash cycle with washing suds, which are disposed in one or more drip trays below the washing zones and are transported via circulating pumps to the lower and upper washing nozzles. The washing suds for a large number of subsequent wash cycles herein remain generally in the machine and are cleaned of dirt in the usual manner and partly regenerated by fresh water. There is therefore no high water consumption for the washing suds.

In contrast to the above, there is required for the re-rinse cycle at least one additional collecting receptacle, in which fresh water for the re-rinse cycle is prepared. In a refinement of the invention, two such re-rinsing systems are provided, which are charged with fresh water and heated up. Only the re-rinsing circuit present at the outlet of the dishwasher, for example, can herein be provided with special re-rinsing agent.

In order to obtain an overall reduction in the energy consumption of the dishwashing machine, there is therefore provided, for the preparation of the rinsing suds for the wash cycle, a thermically insulated collecting receptacle, which, due to the spatial proximity to the re-rinsing zone, is filled during the re-rinse cycle also with re-rinsing liquid. This produces a dilution or regeneration of the washing suds due to the re-rinsing liquid, which is specifically not provided with re-rinsing agent.

A further reduction in energy consumption can also be obtained by the fact that various washing or re-rinsing steps can be performed at different temperatures, the corresponding liquids being received at different temperatures in various collecting receptacles.

BRIEF DESCRIPTION OF THE DRAWINGS

An illustrative embodiment of the invention is represented in the drawings and described in greater detail in the following description, in which drawings.

DETAILED DESCRIPTION OF THE INVENTION

Figure 1:
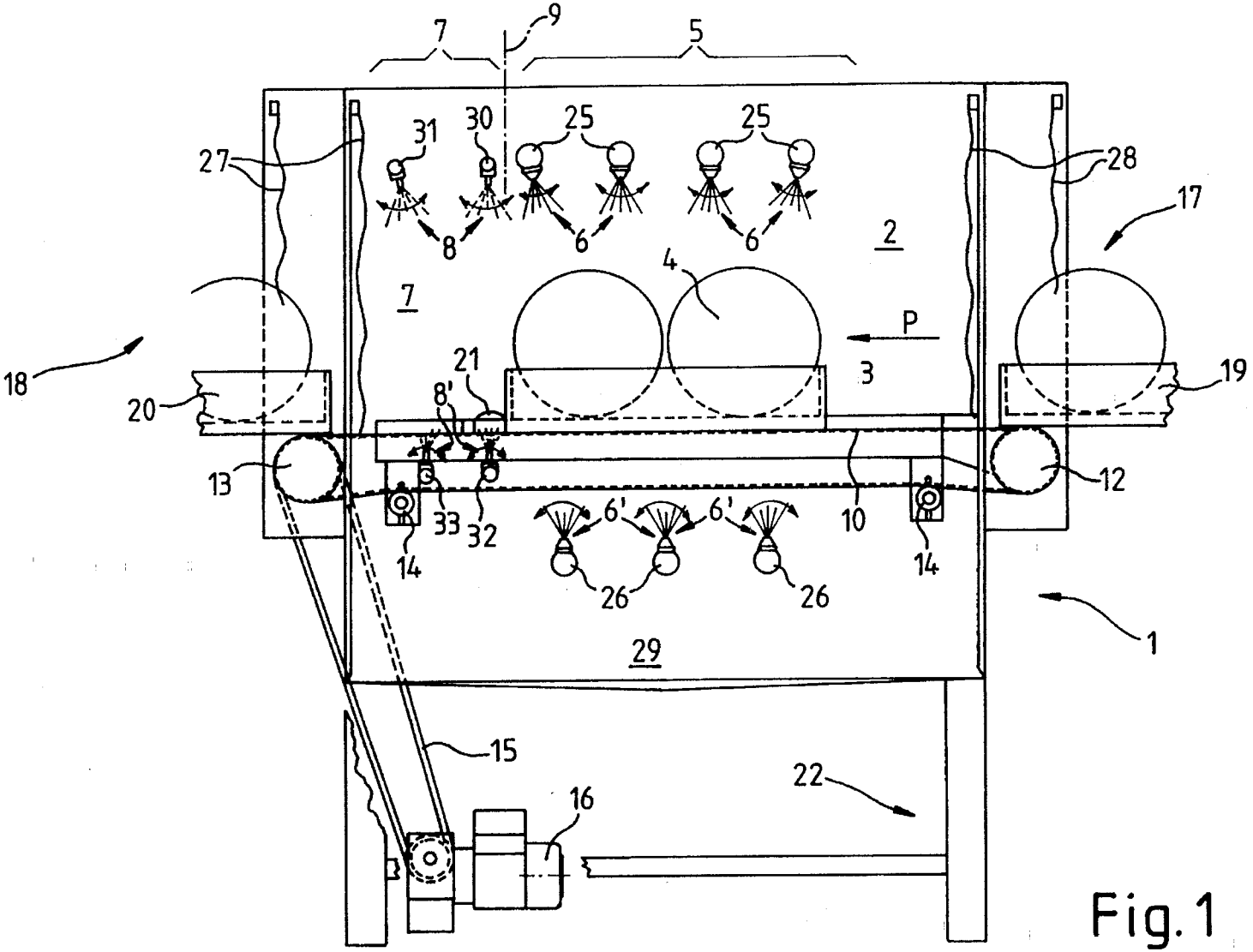
FIG. 1 shows a diagrammatic longitudinal section through a dishwashing machine according to the invention.
Figure 2:
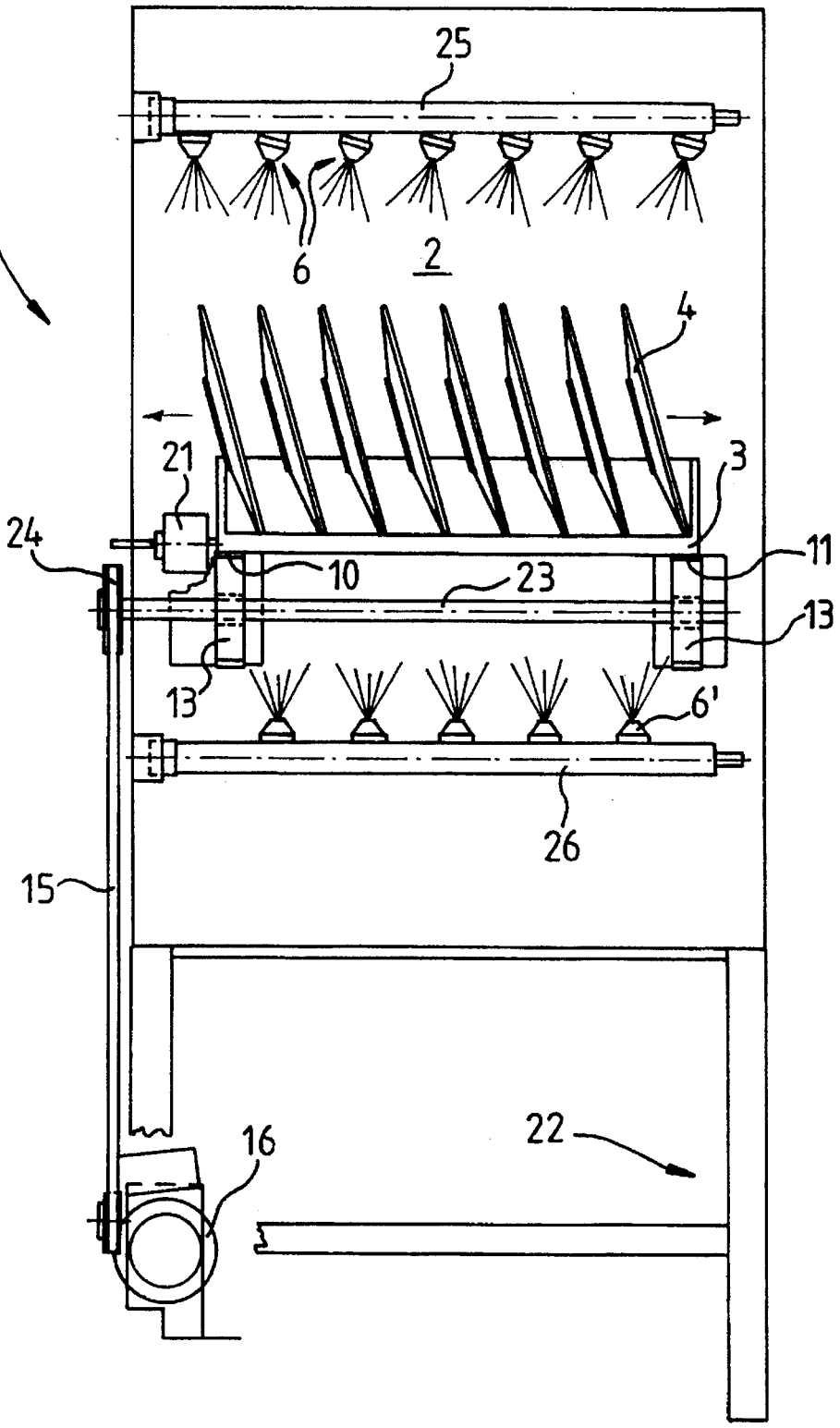
FIG. 2 shows a diagrammatic cross section of the dishwasher according to FIG. 1.
Figure 3:
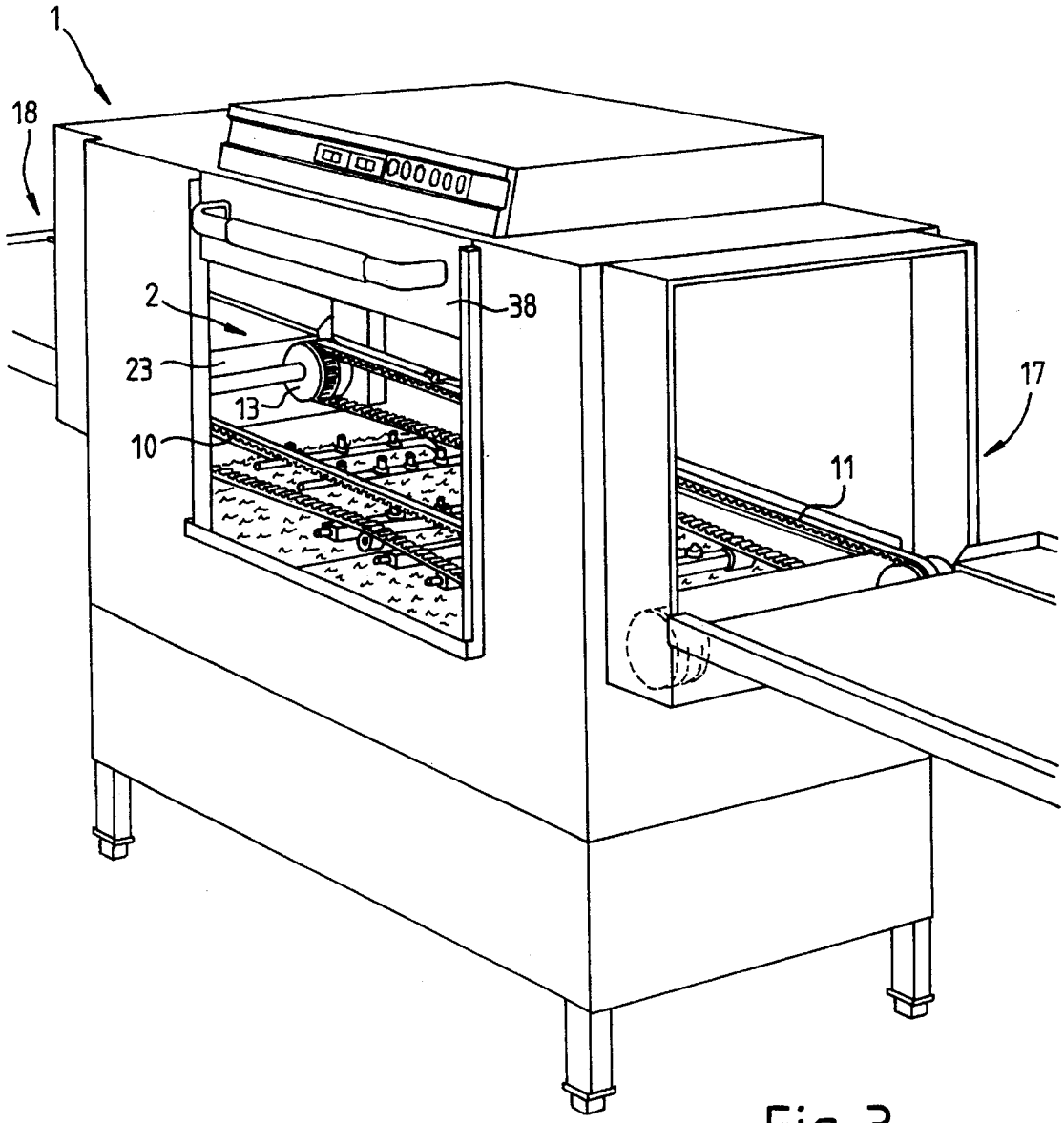
FIG. 3 shows a perspective view of the dishwasher according to FIGS. 1 and 2.
Figure 4:
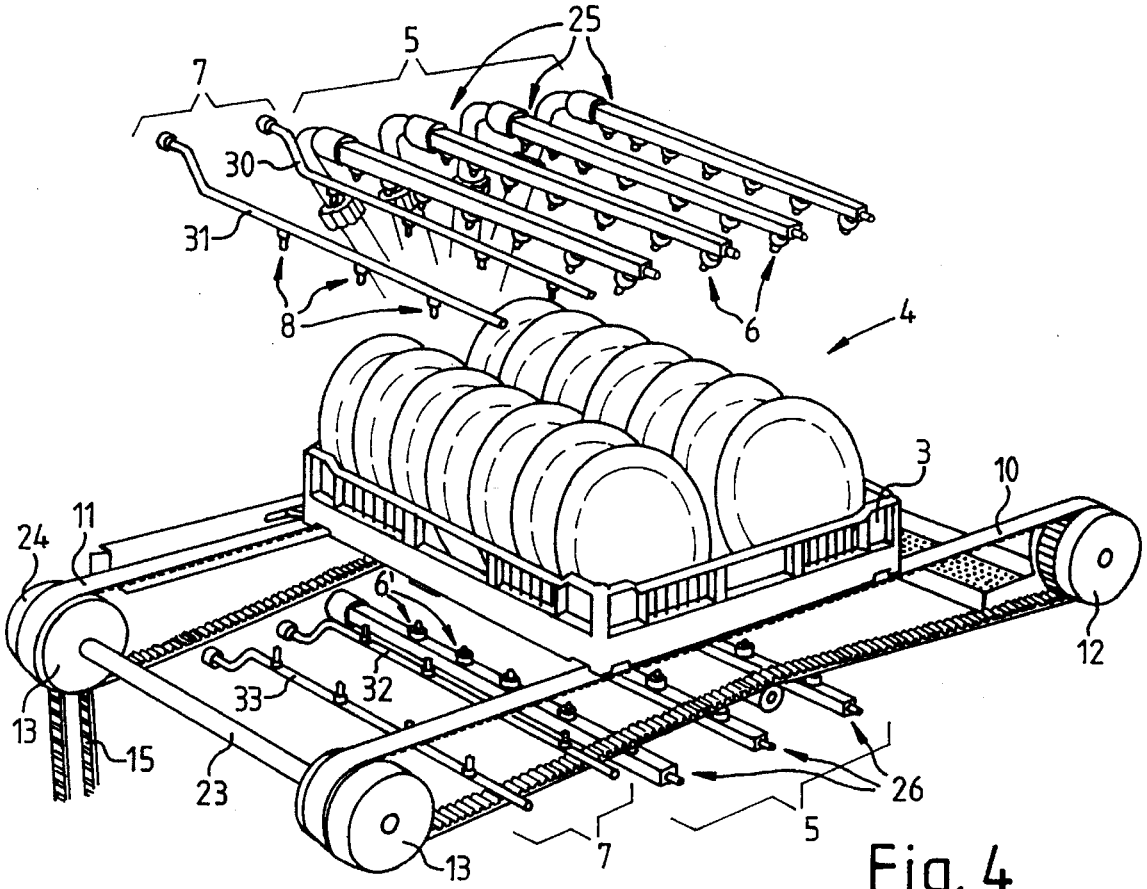
FIG. 4 shows a perspective representation of the washing zone, re-rinsing zone and a drive system.

The dishwasher 1 according to FIGS. 1, 2 and 3 exhibits an interior configured as a rinsing chamber 2 or treatment chamber 2, which interior is divided up into a washing zone 5 and a following re-rinsing zone 7. The imaginary dividing plane 9, which is symbolically drawn in FIG. 1, divides the two spatially adjacent zones. In the washing zone 5 there is located, as represented in FIGS. 1 and 2, a crockery basket or box 3, hereinafter referred to as a "basket", which receives the crockery to be cleaned. The arrangement of the crockery basket 3 in the washing zone 5 according to FIG. 3 is represented in FIG. 4. The crockery basket 3 is filled with crockery 4.

Above and below the crockery basket 3, there are located in the front washing zone, for example, four upper (25) and three lower (26) washing arms 25, 26, to which there are fastened a large number of washing nozzles 6 and 6' respectively, the upper washing arms 25 being disposed laterally offset relative to the lower washing arms 26 so as better to grasp interspaces between the crockery. In the illustrative embodiment, around five to seven washing nozzles 6, 6' are provided on each washing arm 25, 26.

The rinsing chamber 2, which is configured in its left end region as a re-rinsing zone 7, exhibits in this region a plurality of upper (30, 31) and lower (32, 33) re-rinsing arms, which, similarly to the washing arms, are spaced at a certain lateral distance apart and to which there are fastened re-rinsing nozzles 8, 8'.

The crockery basket 3 rests on two transporting devices 10, 11 which are guided next to each other at a distance apart. The transporting devices, which in the present example are configured as conveyor belts 10, 11, run around two deflection rollers 12, 13 and across two guide rollers 14. In the region of the left deflection roller 13 represented in FIGS. 1 and 4, the conveying device is driven, via a part-belt 15, by an electric motor 16.

The rinsing chamber 2 is closed off in its entry region 17 and its exit region 18 by means of two flexible, double strip curtains 27, 28 (FIG. 1). In front of the entry 17, an already prepared,next crockery basket 19 awaits the processing cycle, whilst behind the exit 18, the last rinsed crockery basket 20 is still visible in FIG. 1. In front of the crockery basket 3 located in the rinsing chamber 2, a limit switch 21 is represented, which halts the transportation of the crockery basket 3. The entire dishwasher rests upon a machine stand 22. In the front region, an inspection flap and maintenance flap 38 can be provided.

According to the representation in FIGS. 1 to 4, the conveyor belts 10, 11 of the transporting device for the crockery basket 3 are driven by means of a drive axle 23 and a drive wheel 24. The limit switch 21 is located next to the crockery basket 3, so that the latter, without impacting against it, is able to pass. The washing nozzles 6, 6' are fastened to the washing arms 25, 26, which serve at the same time as supply lines.

Below the washing zone 5 there is located a thermically insulated washing suds receptacle 29, which serves as a collecting receptacle for the washing suds and from which the washing suds gathered in the course of the wash cycle are pumped, via cleaning units (not represented in greater detail), to the individual washing nozzles 6, 6'.

Figure 5:
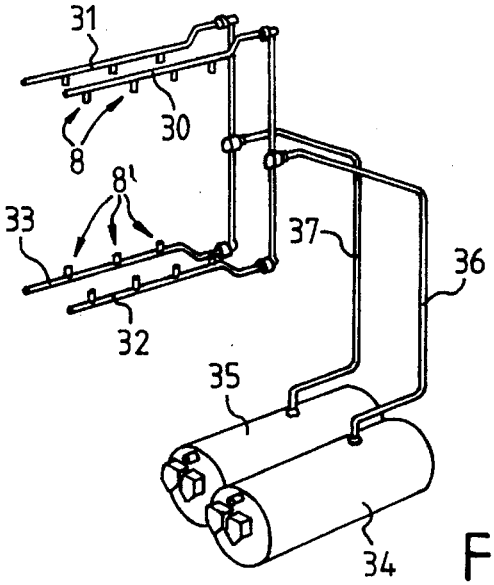
FIG. 5 shows a perspective representation of the re-rinsing arrangement.

As represented from FIGS. 1, 4 and 5, the re-rinsing zone 7 is disposed immediately following the washing zone 5. The re-rinsing zone 7 contains two upper, mutually adjacent re-rinsing arms 30, 31, to the underside of which there are respectively fastened three or four mutually adjacent re-rinsing nozzles 8. Equally, two further, lower re-rinsing arms 32, 33 are provided, which likewise exhibit three or four re-rinsing nozzles 8'. As can be seen from FIG. 5, the re-rinsing zone contains two separate re-rinsing systems having separate collecting receptacles 34, 35 for the re-rinsing liquid, which is guided, via supply lines 36, 37, to the respective re-rinsing arms. The re-rinsing arms 30, 32 and the re-rinsing arms 31, 33 should herein be regarded as respectively belonging together, forming a type of vertical curtain in the re-rinsing zone. As a result of two re-rinsing systems, various temperature steps for the re-rinsing liquid can be set. In particular, it is also possible for just one of the re-rinsing systems, preferably the rear one 35, 31, 33, to be provided with a re-rinsing agent, thereby leading to savings in chemical additives.

The liquid from the two re-rinsing receptacles 34, 35 makes its way, in the re-rinse cycle, likewise into the washing suds receptacle 29 and, because of the high fresh water component, regenerates the washing suds. The re-rinsing system is constantly supplied with fresh water.

The rinse cycle in a dishwasher of this type occurs as follows:

A basket is brought up to the entry region 17 of the rinsing chamber 2. After the machine is started, the basket is received by the conveyor belts 10, 11 of the transporting device and transported into the rinsing chamber 2 according to the arrow direction P. The main wash cycle is conducted in a position of the crockery basket located directly below or above the washing nozzles 6, 6' (see FIGS. 1, 4). This position is set by the actuation of the limit switch 21 by the basket, whereupon the conveyor belts 10, 11 are halted. Up to this instant, the washing nozzles 6, 6' are out of use. The curtain 28, once the basket has traveled in, has fallen back again into its substantially vertical original position. A lateral closure of this type enables a reduction in working temperature and water loss to be obtained. There now begins a wash cycle or wash program in which the washing liquid or rinsing liquid heated in the washing suds receptacle 29 is transported via the cleaning devices into the washing arms 25, 26 and from there into the washing nozzles 6, 6'. The washing time is temporally determined by the wash program. The basket 3 is constituted such that, due to its permeable regions, especially in the lower and upper regions, it does not obstruct the wash cycle.

Following completion of the wash program in the washing zone 5, a short drain-off phase can be inserted. Afterwards, the two conveyor belts 10, 11 set themselves in motion again and the basket 3 runs at slow speed through the re-rinsing zone 7, the re-rinsing nozzles 8, 8' of which are operating as the crockery basket 3 runs through. From the two collecting receptacles 34, 35, different re-rinsing liquid can herein be guided into the two respectively associated re-rinsing arms 30, 32 and 31, 33. The basket 3 then leaves the rinsing chamber 2, via the exit 18, whereupon the next basket 19, if required, can be fed through the entry 17.

The wash and re-rinse cycle respectively is thus only in operation when a basket is actually located in the washing position 5 and the re-rinsing zone 7 respectively. The intermittent transport cycle enables, in contrast to the previous continuously working dishwashers, a substantially smaller construction to be obtained, combined with a considerable saving in energy, water and rinsing agent consumption.

Figure 6:
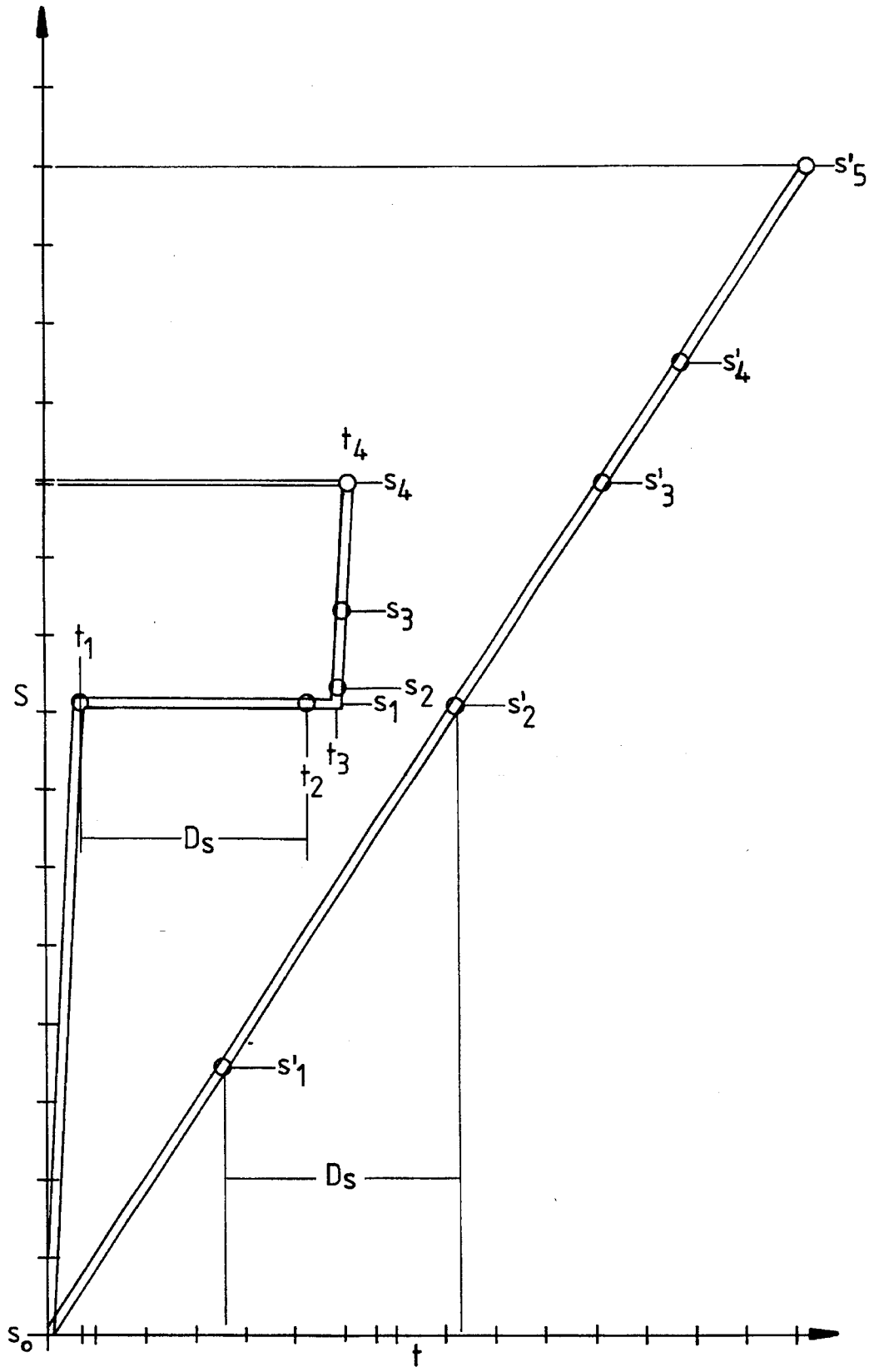
FIG. 6 shows a path-time-comparison diagram between a dishwasher according to the invention and a known process sequence.

The difference from the previous working method of a continuously working system is represented diagrammatically in FIG. 6 by means of a path-time diagram of two rinse cycles. The 45° line shows a conventional rinse cycle, the step-shaped line disposed to the left thereof a rinse cycle according to the invention.

Both wash cycles start at the instant $t_0$, the crockery basket in question being located in the position $s_0$. In a rinse cycle according to the invention, the rinsing position $s_1$ is now firstly reached as quickly as possible. To achieve this, the time up to the instant $t_1$ is required. During the following rinsing period $D_s$, the crockery basket 3 stays in its position $s_1$ up to the instant $t_2$ and remains stationary beyond the end of the wash cycle $t_2$ up to the instant $t_3$, at which instant a short drain-off phase is completed. ($t_3$–$t_2$=drain-off phase). The crockery basket is then conveyed through the re-rinsing zone 7 at very fast speed, the beginning of which lies at the point $s_2$ and the end of which at the point $s_3$. At the instant $t_4$, the crockery basket finally reaches the machine outlet and is located in the position $s_4$.

In the previous working method, the crockery baskets were continuously transported through a long entry zone until entering into the rinsing zone at the point $s_1'$. This long lead-in zone is necessary, since, when crockery baskets are running through constantly, the dividing curtains at the entry of the rinsing zone are constantly being raised slightly and hence rinsing water and vapors might increasingly escape if the entry region were too short. After having entered into the rinsing zone at the point $s_1'$, the crockery basket, in the case of the continuous installation, runs at constant speed through the rinsing zone up to the point $s_2'$. It here enters into a long transition zone until entering into the re-rinsing zone at the point $s_3'$. This wide transition zone between the washing zone and re-rinsing zone becomes necessary, once again, by virtue of all spray nozzles being simultaneously in operation, i.e. including whilst the crockery baskets are raising the dividing curtains. The prevention of any carry-over of suds into the re-rinsing zone thus requires this long transition region up to the point $s_3'$. At the point $s_4'$, the crockery box departs from the re-rinsing zone. Following complete departure from the re-rinsing zone, it finally reaches its end position $s_5'$ in the machine outlet. It is clearly evident, with reference to the two diagrams, that using a rinsing process according to the invention, a machine of substantially shorter construction and actual running time becomes possible. The cyclical working-off of the crockery baskets becomes clear by virtue of the kinked characteristic line, whereas the previous continuous working method is reflected in the straight characteristic line. The two characteristic lines are plotted for an identically maximal performance. As can be seen in the diagram, the advantage, in continuous operation, of a plurality of crockery baskets running through the machine simultaneously is counterbalanced, in a rinsing process according to the invention, by a substantially shorter processing time for the individual rinsing basket.

The manifold advantages of a rinsing process according to the invention become particularly pronounced when the machine is operated at less than full capacity. Whereas, in the continuous process, all rinsing units have to be engaged in permanent operation, even for the passage of a single crockery basket, the rinsing circuit of a dishwasher according to the invention operates only during the actual rinse cycle. The main washing nozzles are switched off even before the re-rinsing zone has been entered. Considerable savings on water, energy and rinsing agent are thereby achieved.

A further energy saving is produced by the concerted temperature graduation in the two collecting receptacles 34, 35 for the re-rinse cycle. A concerted after-treatment of the crockery, using re-rinsing liquid which has been heated to a different temperature and provided with re-rinsing agent, can thereby be conducted.

The invention also envisages that, following the discharge of a crockery basket at the end of the rinse cycle, the transporting apparatus continues running for a predetermined time span. If, within this time span, a crockery basket is once again fed in, then the previously described cycle is repeated. Once the time span has expired without a crockery basket having freshly been fed in, the transporting apparatus also comes to a halt. In this case, the dishwasher has to be manually re-started.

The transporting device comprising the two conveyor belts 10, 11, because of its lateral position, allows unobstructed access in the middle region or to the underside of the crockery baskets by the washing or re-rinsing nozzles. A corresponding open configuration of the lower region of the crockery basket allows lower access to the crockery. Furthermore, optional crockery baskets having a suitable base layout can be used, since bars on the underside for the engagement of pawls for a conventional push rod are no longer required. Advantageously, the transporting device causes or allows the crockery basket to oscillate in the direction of the arrows in FIG. 2, to further facilitate cleaning of the crockery.

Depending upon the purpose of use, the washing nozzles 6, 6' and the re-rinsing nozzles 8, 8' respectively can be pivotal in the direction of the arrows in FIG. 1, in order to obtain good accessibility to the crockery parts, especially where dirt is difficult to remove, and hence achieve improved washing results.

The invention is not confined to the described and represented illustrative embodiment. Rather, it also embraces all expert refinements within the scope of the inventive concept.

We claim:

1. A dishwashing machine for cleaning crockery, comprising:

a crockery treatment chamber having an entry opening, including:

a washing zone located immediately subsequent to the entry opening;

a plurality of washing nozzles for washing the crockery within said washing zone during a program controlled washing cycle;

a rinsing zone located immediately adjacent to and immediately following said washing zone; and a plurality of rinsing nozzles for rinsing the crockery within said rinsing zone during a program controlled rinsing cycle, the rinsing cycle occurring only during an inoperative stage of the washing cycle and during a transportation of the crockery;

a program controlled transporting device longitudinally traversing said rinsing chamber for transporting the crockery through the entry opening, said washing zone and said rinsing zone, respectively; and program control means for automatically controlling the rinsing cycle, the washing cycle, and movement of said transporting device, said program control means causing the crockery to be transported on said transporting device through the entry opening and into said washing zone at a rapid speed, stopping said transporting device to cause the crockery to dwell within said washing zone during the washing cycle for a controlled period of time, and subsequently transporting the crockery into and through said rinsing zone simultaneous with the rinsing cycle.

2. The dishwasher defined in claim 1, further comprising a drain-off cycle temporally located between the washing cycle and the rinsing cycle.

3. The dishwasher defined in claim 1, further comprising a thermically insulated collecting receptacle located below said rinsing chamber for receiving a washing liquid.

4. The dishwasher defined in claim 1, further comprising a plurality of collecting receptacles connected to at least one of said plurality of rinsing nozzles and said plurality of washing nozzles, each containing one of a washing liquid and a rinsing liquid having different temperatures.

5. The dishwasher defined in claim 1, further comprising a limit switch located in said washing zone and being actuatable by a crockery basket, said limit switch generating a signal for switching off said transporting device when the crockery is located in said washing zone and in a washing position.

6. The dishwasher defined in claim 1, wherein said transporting device comprises one of a plurality of conveyor belts and a plurality of conveyor chains located laterally in said rinsing chamber.

7. The dishwasher defined in claim 1, wherein said washing zone has a length that corresponds at least to a length of a crockery basket.

8. The dishwasher defined in claim 1, wherein said rinsing zone is located in an outlet region of said rinsing chamber and has a length that corresponds generally to half a length of said washing zone.

9. The dishwasher defined in claim 1, wherein at least one of said rinsing nozzles and said washing nozzles are pivotable to swing a water jet in a back-and-forth motion.

10. The dishwasher defined in claim 1, further comprising means for oscillating a crockery basket located within said rinsing chamber.

11. The dishwasher defined in claim 1, wherein said rinsing chamber has an exit opening; further comprising a loosely down-hanging, flexible, double curtain closing off at least one of the entry opening and the exit opening.

12. The dishwasher defined in claim 1, wherein the washing cycle begins during a feed of a crockery basket into said washing zone, and wherein the rinsing cycle occurs during an onward transportation of the crockery basket on said transporting device.

13. The dishwasher defined in claim 12, wherein said transporting device causes the crockery to dwell within said rinsing zone for a preselected time.

14. The dishwasher defined in claim 1, wherein said transporting device continues to run for a preselected time after discharging the crockery from said rinsing chamber so as to receive and transport additional crockery to be cleaned to said rinsing chamber.

15. The dishwasher defined in claim 14, wherein said transporting device is automatically halted after the preselected time if the additional crockery to be cleaned is not present.

16. The dishwasher defined in claim 1, wherein a new crockery basket is fed into said rinsing chamber as a treated crockery basket is transported out of said rinsing chamber.

17. A method of cleaning crockery, comprising the steps of:

(A) providing a dishwashing machine having:

(1) a crockery treatment chamber having an entry opening, including:

(a) a washing zone located immediately subsequent to the entry opening;

(b) a plurality of washing nozzles for washing the crockery within the washing zone;

(c) a rinsing zone located immediately adjacent to and immediately following the washing zone; and (d) a plurality of rinsing nozzles for rinsing the crockery within the rinsing zone; and (2) a program controlled transporting device longitudinally traversing the rinsing chamber for transporting the crockery through the entry opening, the washing zone and the rinsing zone, respectively;

(B) transporting the crockery on the transporting device through the entry opening and into the washing zone at a rapid speed;

(C) washing the crockery located in the washing zone using the washing nozzles;

(D) stopping the transporting device to cause the crockery to dwell in the washing zone for a controlled period of time during said washing step;

(E) transporting the crockery from the washing zone through the rinsing zone subsequent to said washing step;

(F) rinsing the crockery located in the rinsing zone using the rinsing nozzles only during a nonoccurrence of said washing step and during said transporting step (E); and (G) controlling a temporal sequencing of said rinsing step, said washing step, said stopping step, and said transporting steps.

18. The method defined in claim 17, further comprising the step of feeding a crockery basket containing the crockery into the washing zone; causing said washing step to begin during said feeding step; and causing the crockery to dwell within the rinsing zone during said transporting step for a preselected time.

19. The method defined in claim 17, further comprising the steps of discharging the crockery from the rinsing chamber; causing the transporting device to continue to run for a preselected time after said discharging step; receiving additional crockery during said causing step and transporting the additional crockery to be cleaned to the rinsing chamber; and automatically halting the transporting device after the preselected time if the additional crockery to be cleaned is not present during said receiving step.

20. The method defined in claim 17, further comprising the steps of transporting a treated crockery basket out of the rinsing chamber; and feeding a new crockery basket into the rinsing chamber as the treated crockery basket is transported out of the rinsing chamber.

* * * * *